US005797314A

United States Patent [19]

Hendrick

[11] Patent Number: 5,797,314

[45] Date of Patent: Aug. 25, 1998

[54] MANUAL TRASH COMPACTOR

[76] Inventor: Paul Hendrick, 37290 W. Menlo, Hemet, Calif. 92545

[21] Appl. No.: 915,452

[22] Filed: Aug. 20, 1997

[51] Int. Cl.[6] ..... B30B 15/06

[52] U.S. Cl. ..... 100/265; 100/295; D8/77

[58] Field of Search ..... 100/226–228, 100/240, 265, 295, 299; D8/77; 404/133.1

[56] References Cited

U.S. PATENT DOCUMENTS

| | | | |
|---|---|---|---|
| 947,548 | 1/1910 | Lind | 404/133.1 |
| 2,234,831 | 3/1941 | Porter | 404/133.1 |
| 2,988,972 | 6/1961 | Cooper | 404/133.1 |
| 2,994,262 | 8/1961 | Bator | 404/133.1 |
| 4,158,995 | 6/1979 | Kaplan et al. | 100/240 |
| 4,658,720 | 4/1987 | Massonnet | 100/226 |
| 4,682,539 | 7/1987 | Bramblett et al. | 100/265 |

FOREIGN PATENT DOCUMENTS

| | | | |
|---|---|---|---|
| 2915349 | 10/1980 | Germany | 100/240 |

*Primary Examiner*—Stephen F. Gerrity

*Attorney, Agent, or Firm*—Goldstein & Canino

[57] ABSTRACT

A manual trash compactor comprising a base, having a top surface and a handle, having a proximal end and a distal end. A socket is hollowed out of the top surface of the base with an upwardly extending flange on each side of the socket. The proximal end of the handle is smaller in diameter than the rest of the handle. The proximal end fits into the socket on the top surface of the base. Each flange has a bore extending through it, both bores aligned with each other. The proximal end of the handle has a slot extending through it, so that when the handle is placed in the socket, the bores and the slot are aligned. A pin is inserted through the bores and the slot, thereby locking the handle into position in the base. The shape of the base is either a foot or a hand. Interchangeable handles, namely, T-shaped, L-shaped or straight, are attached to a base.

5 Claims, 3 Drawing Sheets

MANUAL TRASH COMPACTOR

BACKGROUND OF THE INVENTION

The invention relates to a manual trash compactor. More particularly, the invention is a manual compactor for use in household or yard garbage pails.

Whether living alone or with a big family, people create a lot of household garbage. People living in houses also tend to create a lot of garbage when working in or cleaning up their yards. Especially during the fall, people will find themselves with numerous bags piled in front of their houses filled with leaves.

Depending on the area that the person lives, garbage is usually picked up by sanitation workers only twice a week.

If no pickup service is offered, people must take their trash to a local dump. Because of these restrictions, it is beneficial to fit as much garbage as possible in only a few garbage bags.

Because of the nature of garbage, most people prefer not to touch the refuse. Therefore, a lot of unoccupied space is left in garbage bags. Thus, more and more bags are used to hold the trash which means either large piles of bags in front of one's house or numerous trips to the local dump.

There is a need in the field for a device that would allow a user to pack down the garbage in a bag without actually having to touch the garbage.

U.S. Pat. No. 4,991,500 to Knapp discloses a refuse compactor device having a container that is designed to hold a trash bag.

U.S. Pat. No. Des. 243,315 to Smith discloses a unique design for a tamping device.

While these units may be suitable for the particular purpose employed, or for general use, they would not be as suitable for the purposes of the present invention as disclosed hereafter.

SUMMARY OF THE INVENTION

It is an object of the invention to produce a manual trash compactor. More particularly, the invention is a manual compactor for use in household or yard garbage pails.

It is a further object of the invention to produce a manual trash compactor that allows a user to pack down the garbage in a bag without ever having to actually touch the garage.

It is further object of the invention to produce a manual trash compactor that is available in a variety of sizes. Thus, a user can choose a size depending on the size of the pail in which the garbage is contained.

It is a still further object of the invention to produce a manual trash compactor that is available with a variety of handles. Depending on which handle is chosen, the user can pack down the garbage from several different angles. The use of the handles also eliminates any strain that may be felt on one's back. The garbage can be compacted while standing in an upright position.

It is a still further object of the invention to produce a manual trash compactor wherein any one of the handles are attachable to any size of the base portion of the compactor.

Once the handle is attached to the base portion, the handle can pivot around a pin to allow to a wide variety of angles.

The invention is a manual trash compactor comprising a base, having a top surface and a handle, having a proximal end and a distal end. A socket is hollowed out of the top surface of the base with an upwardly extending flange on each side of the socket. The proximal end of the handle is smaller in diameter than the rest of the handle. The proximal end fits into the socket on the top surface of the base. Each flange has a bore extending through it, both bores aligned with each other. The proximal end of the handle has a slot extending through it, so that when the handle is placed in the socket, the bores and the slot are aligned. A pin is inserted through the bores and the slot, thereby locking the handle into position in the base. The shape of the base is either a foot or a hand. Interchangeable handles, namely, T-shaped, L-shaped or straight, are attached to a base.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
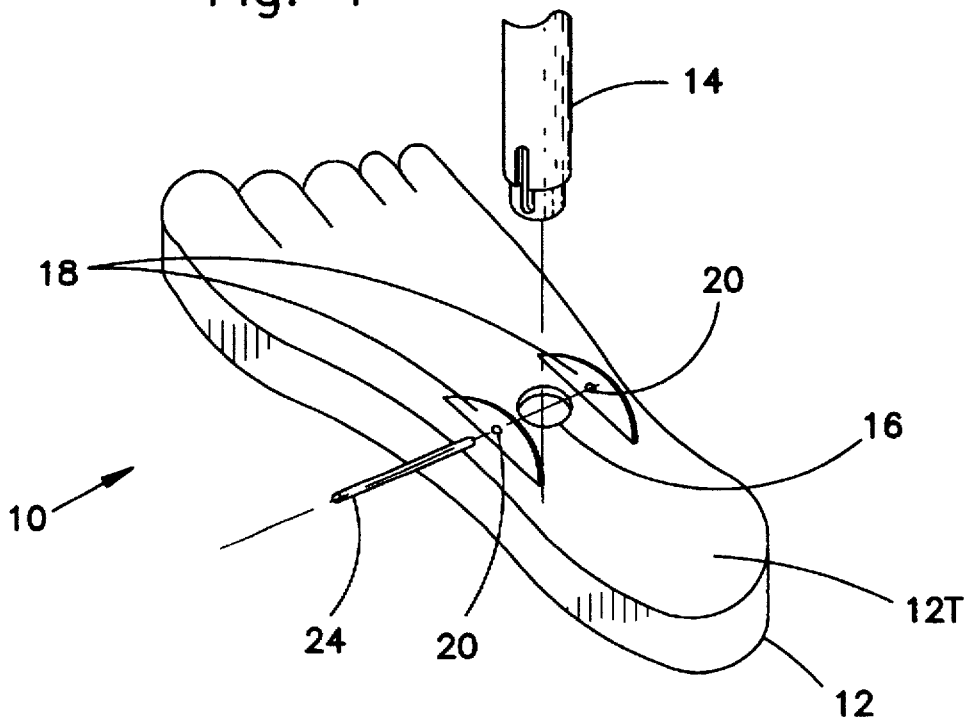
FIG. 1 is a perspective view of a base of the manual trash compactor it the shape of a foot.
Figure 2:
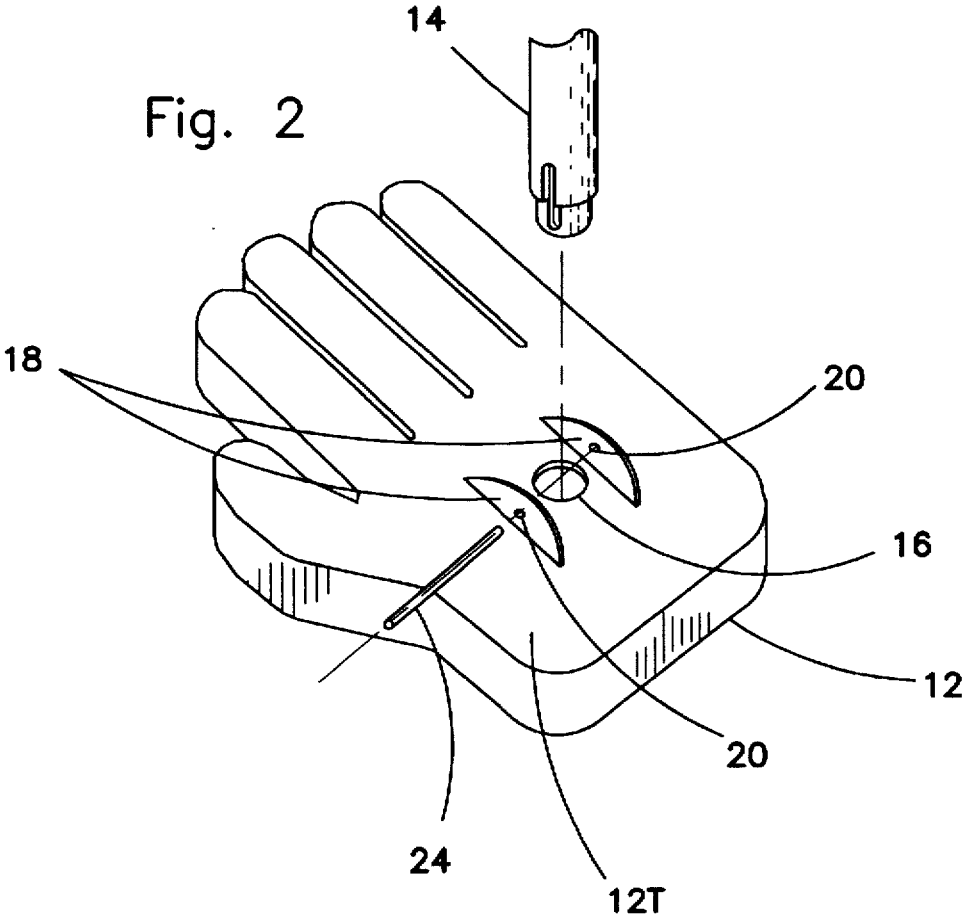
FIG. 2 is a perspective view of a second base of the manual trash compactor in the shape of a foot.
Figure 3:
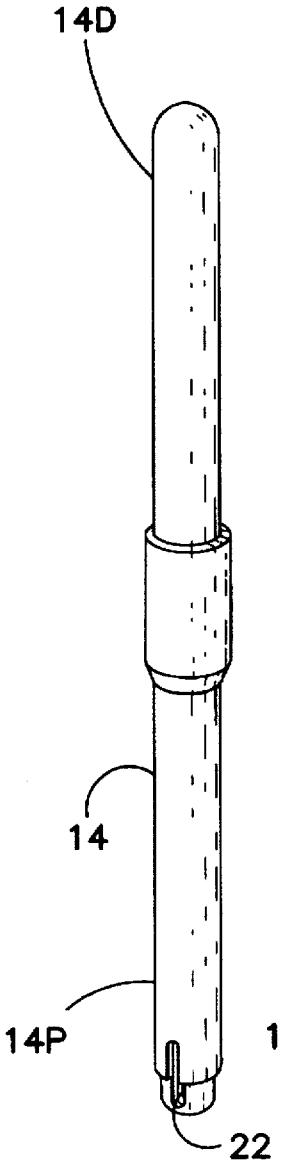
FIG. 3 is a perspective view of a handle for the instant invention.
Figure 4:
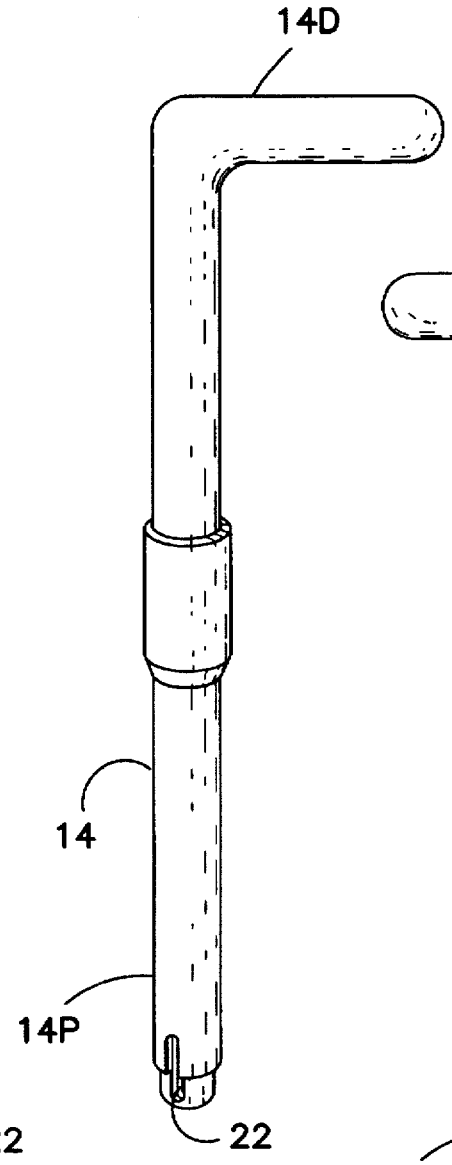
FIG. 4 is a perspective view of a L-shaped handle for the instant invention.
Figure 5:
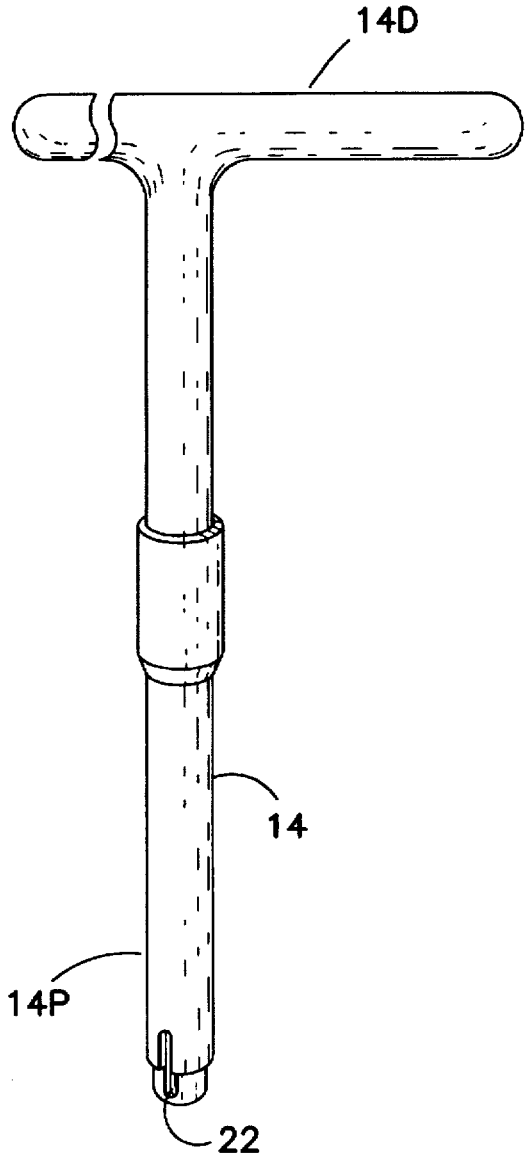
FIG. 5 is a perspective view of a T-shaped handle for the manual trash compactor.

The instant invention is a manual trash compactor 10, comprising a base 12, having a top surface 12T, and a handle 14, said handle 14 attached to the top surface 12T of the base 12. FIGS. 1 and 2 illustrate two different designs for the base 12, namely a foot and a hand. FIGS. 3, 4 and 5 illustrates three different designs for the handle 14, namely a straight handle in FIG. 3, an L-shaped handle in FIG. 4, and a T-shaped handle in FIG. 5.

Referring to FIGS. 1 and 2, the base 12 has a socket 16 in the middle of the top surface 12T of said base 12. Two upwardly extending flanges 18 extend perpendicular from the top surface 12T of the base 12, each on opposite sides of the socket 16. A bore 20 extends through the middle of each flange 18, each bore 20 aligned with the other.

Referring to FIGS. 3, 4, and 5, the handle 14 has a proximal end 14P and a distal end 14D. The proximal end 14P of the handle 14 is indented and therefore smaller in diameter than the rest of the handle 14. This end 14P fits into the socket 16 found on the top surface 12T of the base 12. A slot 22 extends through the proximal end 14P of the handle 14.

When the proximal end 14P of the handle 14 is placed into the socket 16 on the top surface 12T of the base 12, a flange 18 is situated on either side of the handle 14. The slot 22 found on the handle 14 should be aligned with the bore 20 extending through each flange 18. In order to lock the handle 14 into position, a pin 24 is inserted through the bore 20 of the first flange 18, into the slot 22 of the handle 14, and through the bore 20 of the second flange 18.

Figure 6:
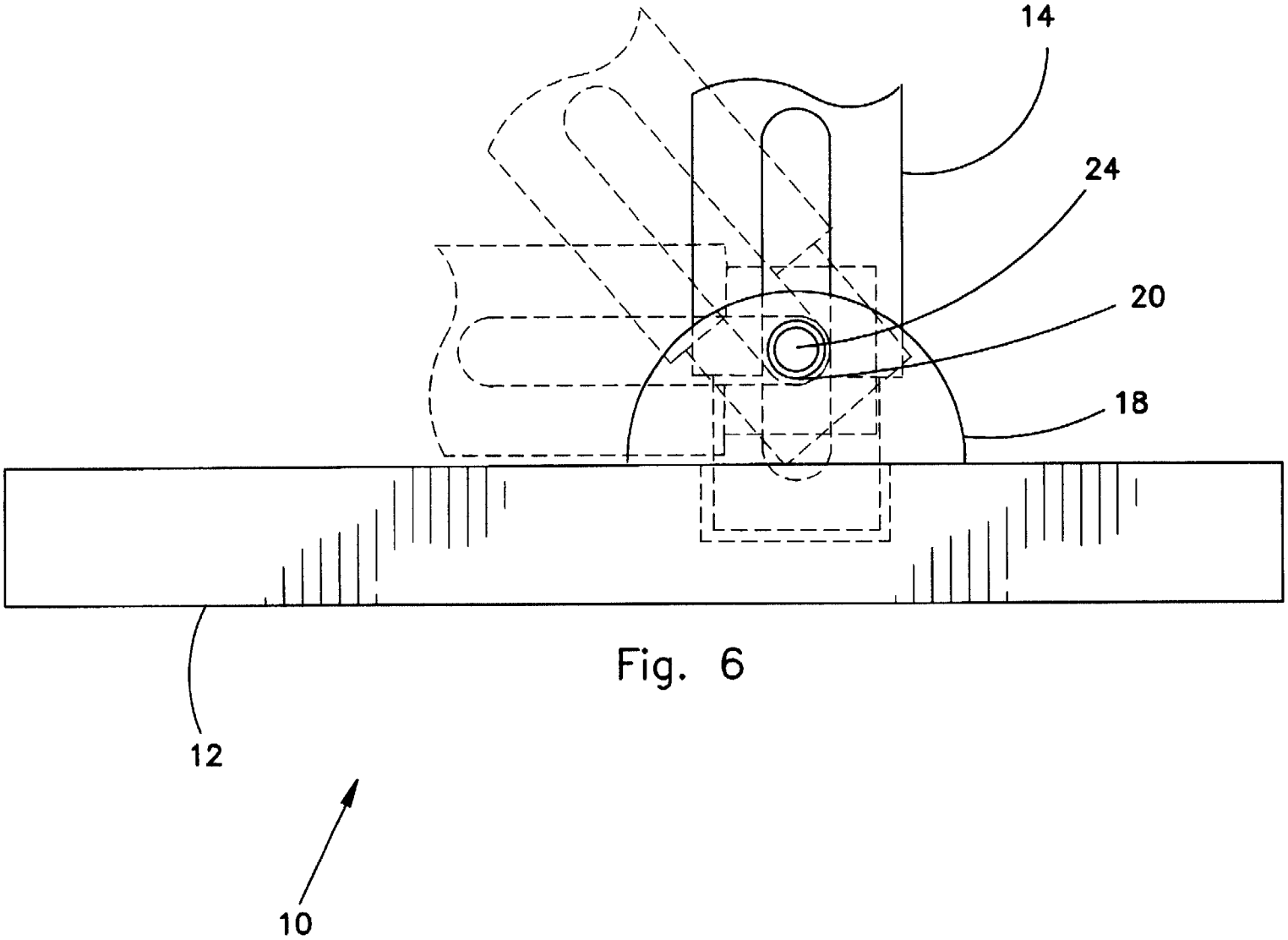
FIG. 6 is a side view of the instant invention, illustrating the possible pivotal motion of the handle upon the base.

Referring to FIG. 6, the handle 14 can either be locked into one position on the base 12, as illustrated in solid lines, or it can be free to fold, while still attached to the base 12, as illustrated in dotted lines. If the handle 14 is just rested on the socket 16, without penetrating the base 12, the handle 14 will be able to fold ninety degrees in either direction. However, if the proximal end 14P of the handle 14 is pressed into the socket 16, the handle 14 will be locked in an upright position, perpendicular to the base 12.

The base 12 should be available in a variety of sizes and shapes. A base 12 in the form of a foot, as illustrated in FIG. 1, can be utilized in long and narrow pails. A base in the form of a hand, as illustrated in FIG. 2, can be utilized in a wide pail. The bases 12 will also be available in different sizes, such as small, medium or large, to further accommodate the type and size of the pail in which garbage is to be compacted.

The handle 14 should also be available in a variety of shapes to accommodate different types of jobs. FIG. 3 illustrates a straight handle. This type of handle 14 would be best suited for jobs involving light refuse since it is designed to be used with one hand. The L-shaped handle of FIG. 4 can be used to vertically compress garbage. The T-shaped handle, illustrated in FIG. 5, is better suited for heavy duty jobs, since it is designed to be used with two hands.

What is claimed is:

1. A manual compactor, for compacting garbage in household or yard garbage pails, comprising:

a base, having a top surface, and a socket hollowed out of the center of the top surface wherein two upwardly extending flanges extend perpendicular to the top surface of the base, each on opposite sides of the socket, said flanges each having a bore extending through the flange wherein the bores are aligned with each other; and a handle, having a proximal end and a distal end, wherein the proximal end fits into the socket on the top surface of the base, the handle shape is selected from the group consisting of a T-shaped handle and an L-shaped handle.

2. The manual trash compactor as recited in claim 1, wherein a slot extends through the proximal end of the handle, said slot aligned with the bores in the flanges when the handle is inserted into the socket on the top surface of the base.

3. The manual trash compactor as recited in claim 2, wherein a pin is inserted through the bore of one flange, through the slot of the handle and lastly, through the bore of the second flange, thus locking the handle into position on the base.

4. The manual trash compactor as recited in claim 3, wherein the handle rests on the socket of the top surface of the handle, thereby allowing the handle to fold at a ninety degree angle.

5. The manual trash compactor as recited in claim 3, wherein the handle penetrates the top surface of the base and is pressed into the socket, thereby locking the handle in an upright position.

* * * * *